US009401136B2

(12) United States Patent
Tomizawa

(10) Patent No.: US 9,401,136 B2
(45) Date of Patent: Jul. 26, 2016

(54) NOISE REDUCING DEVICE

(71) Applicant: MURATA MANUFACTURING CO., LTD., Kyoto-fu (JP)

(72) Inventor: Yosuke Tomizawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/959,381

(22) Filed: Dec. 4, 2015

(65) Prior Publication Data

US 2016/0180829 A1 Jun. 23, 2016

(30) Foreign Application Priority Data

Dec. 18, 2014 (JP) ..... 2014-256475

(51) Int. Cl.
*G10K 11/16* (2006.01)
*G10K 11/00* (2006.01)

(52) U.S. Cl.
CPC ..... *G10K 11/161* (2013.01); *G10K 11/002* (2013.01)

(58) Field of Classification Search
CPC ..... G10K 11/161; G10K 11/002
USPC ..... 181/224, 225, 230, 232, 238, 239
See application file for complete search history.

(56) References Cited

U.S. PATENT DOCUMENTS 700,785 A * 5/1902 Kull ..... F01N 1/08 181/239
5,166,479 A * 11/1992 Gras ..... F01D 25/02 181/256
6,104,608 A * 8/2000 Casinelli ..... F24F 13/24 181/224
6,283,246 B1 * 9/2001 Nishikawa ..... F01N 1/06 181/255
6,576,028 B2 * 6/2003 Santos ..... G10K 11/161 181/239
7,201,254 B2 * 4/2007 Redmann ..... G10K 11/161 181/204
7,845,463 B2 * 12/2010 Yabe ..... F01N 1/10 181/198
2004/0177613 A1 * 9/2004 DePenning ..... F01K 9/04 60/649
2014/0083796 A1 * 3/2014 Kitamura ..... G10K 11/161 181/286
2016/0003162 A1 * 1/2016 Beck ..... F23R 3/002 60/725

FOREIGN PATENT DOCUMENTS

JP H07-158418 A 6/1995

* cited by examiner

*Primary Examiner* — Jeremy Luks
(74) *Attorney, Agent, or Firm* — Studebaker & Brackett PC

(57) ABSTRACT

A noise reducing device for an apparatus provided with a plurality of discharge passages and that is to be used for reducing noise originating from discharge gas discharged from the discharge passages. The noise reducing device including: (a) a plurality of primary sound reducers that are connected to the plurality of discharge passages of the apparatus; and (b) a secondary sound reducer that accommodates a part of each of the plurality of primary sound reducers including at least a discharge port and that includes a space that allows the discharge gas that has passed through the primary sound reducers and been discharged from the discharge ports to pass therethrough, and a system-to-outside discharge unit that allows the discharge gas that has passed through the space to be discharged to outside of the system.

3 Claims, 5 Drawing Sheets

NOISE REDUCING DEVICE

CROSS REFERENCE TO RELATED APPLICATIONS

This application claims benefit of priority to Japanese Patent Application 2014-256475 filed Dec. 18, 2014, the entire content of which is incorporated herein by reference.

TECHNICAL FIELD

The present disclosure relates to noise reducing devices and for example specifically relates to a noise reducing device for reducing noise caused by shock waves, compression waves and so forth generated with the flow of air in a component sorting apparatus or the like that employs compressed air.

BACKGROUND

Shock waves, compression waves and so forth generated with the flow of air in, for example, characteristic sorting machines or appearance sorting machines that sort non-defective products and defective products using compressed air and manufacturing apparatuses employing compressed air actuators are a cause of noise.

Accordingly, there are noise reducing devices (sound reducers), such as the one disclosed in Japanese Unexamined Patent Application Publication No. 7-158418, for reducing noise generated with the flow of air.

As illustrated in FIG. 4, in Japanese Unexamined Patent Application Publication No. 7-158418, a sound reducer 150 is proposed in which a sound reducing case 101 is formed by providing a front cover 105 and a rear cover 106 at front and rear ends of a cylindrical body 104, an introduction port 105*a* through which a noise air flow is introduced is provided in the front cover 105, air flow lead out passages 106*b* are provided in the rear cover 106 and sound reduction is performed in a sound reducing chamber 107 formed inside the cylindrical body 104. In the sound reducer 150, part of the surface of the rear cover 106, the part of the surface facing the introduction port 105*a*, is an air flow reflecting surface 106*a*, the lead out passages 106*b* of the rear cover 106 are formed outside the reflecting surface 106*a*, first and second sound absorbing filters 108 and 109 are arranged at the entrance and exit of each lead out passage 106*b* and a space between the sound absorbing filters 108 and 109 serves as a sound reducing chamber 110.

This sound reducer is used by connecting gas discharged from a noise generating source 103 to the above-mentioned introduction port 105*a* using a discharge line (piping) 102.

However, when sound reduction is performed using the above-described noise reducing device (sound reducer) 150 having a configuration in which one introduction port (pipe connection portion) 105*a* and one sound reducing case 101 are provided, there is a problem in that the dimensions need to be made large in order to try and obtain a large sound reduction effect and it becomes difficult to arrange the noise reducing device close to the noise generating source 103 in such a case.

In addition, when attempting to reduce noise from an apparatus 103, which is a noise generating source having a plurality of discharge lines, by using a noise reducing device (sound reducer) provided with one introduction port (pipe connection portion) 105*a* and one sound reducing case 101 such as the noise reducing device (sound reducer) 150 of Japanese Unexamined Patent Application Publication No. 7-158418, it has been for example thought that noise reduction could be performed by first collecting the discharge lines 102*a* together using an integrating component 120 and then introducing the plurality of discharge lines 102*a* into the noise reducing device (sound reducer) 150 as schematically illustrated in FIG. 5. In this case, it would be necessary to use a noise reducing device (noise reducer) 150 having a sound reducing effect proportional to the number of discharge lines 102*a*.

However, there is a problem in that discharge gas that has reached the integrating component 120 via the plurality of discharge lines 102*a* flows back into other discharge lines (for example, a discharge line that is not discharging discharge gas or a discharge line having a low pressure) 102*a*, the pressure in the discharge lines 102*a* into which discharge gas has flowed increases and the resistance to the discharge gas becomes high. When the discharge efficiency of the discharge lines 102*a* decreases due to the resistance to the discharge gas becoming high, there is a problem in that when the apparatus 130, which is a noise generating source, is a component sorting apparatus as described above for example, the apparatus 130 becomes unable to accurately sort non-defective products and defective products from each other.

Accordingly, a method has also been considered in which a check value (not illustrated) is provided in each of the discharge lines 102*a* in order to prevent the reverse flow (back flow) of the discharge gas into the discharge lines 102*a* as described above. However, if the ON-OFF operation frequency of the check values is high, the values undergo wear and the reliability of reverse flow prevention is degraded. Therefore, there is a problem in that a mechanism for checking a replacement period needs to be provided and the cost of providing the checking mechanism is incurred in addition to the cost of providing the check valves.

In addition, there is a problem in that it is considered that a configuration must be adopted in which the use period is used as a criterion in order that a check valve can be replaced before the reverse flow prevention function is degraded and therefore the economic burden is increased in this case.

Furthermore, a method has also been considered in which noise is reduced by installing a noise reducing device for each of the plurality of discharge lines 102*a*, but a large-size noise reducing device capable of obtaining a sufficient sound reduction effect would have to be installed for each of the plurality of discharge lines 102*a* in order to obtain a sufficient sound reduction effect and therefore space is needed. If a small-size noise reducing device was installed for each of the plurality of discharge lines 102*a*, although the installation space would be small, there would be a problem in that the sound reduction effect would be insufficient.

SUMMARY

The present disclosure was made in order to solve the above-described problems and an object thereof is to provide a noise reducing device that is capable of reducing noise generated in an apparatus provided with a plurality of discharge passages while suppressing back flow of a discharge gas among the plurality of discharge passages.

In order to solve the above-described problems, a noise reducing device of an embodiment of the present disclosure is for an apparatus provided with a plurality of discharge passages and is used for reducing noise originating from discharge gas discharged from the discharge passages, the noise reducing device including:

(a) a plurality of primary sound reducers that are respectively connected to the plurality of discharge passages, the plurality of primary sound reducers each including
  a discharge gas introduction port through which a discharge gas discharged from the corresponding discharge passage is introduced,
  a sound reducing region that communicates with the discharge gas introduction port and reduces noise by allowing the discharge gas introduced from the discharge gas introduction port to pass therethrough, and
  a discharge port through which the discharge gas that has passed through the sound reducing region is discharged; and (b) a secondary sound reducer that accommodates a part of each of the plurality of primary sound reducers including at least the discharge port and that includes
  a space that allows the discharge gas that has passed through the primary sound reducers and been discharged from the discharge ports to pass therethrough, and
  a system-to-outside discharge unit that allows the discharge gas that has passed through the space to be discharged to outside of the system.

Pressure loss when moving from the space to outside the system in the system-to-outside discharge unit of the secondary sound reducer is lower than pressure loss when moving from the space to the sound reducing regions in the discharge ports of the plurality of primary sound reducers.

In the noise reducing device of the embodiment of the present disclosure, it is preferable that a sound reducing material be provided in the system-to-outside discharge unit of the secondary sound reducer.

By providing the sound reducing material in the system-to-outside discharge unit of the secondary sound reducer, a higher noise reduction effect can be obtained.

In addition, it is preferable that the number of system-to-outside discharge units of the secondary sound reducer is smaller than the number of discharge ports of the primary sound reducers.

Assuming that a configuration is adopted with which a situation in which a discharge gas discharged from the plurality of primary sound reducers into the space of the secondary sound reducer flows back into the apparatus from any of the primary sound reducers is suppressed and low pressure loss is obtained such that the discharge gas can be discharged to outside the system, the configuration of the secondary sound reducer can be simplified by making the number of system-to-outside discharge units of the secondary sound reducer be less than the number of discharge ports of the primary sound reducer and the embodiment of the present disclosure can be made more effective.

The noise reducing device of the embodiment of the present disclosure includes a plurality of primary sound reducers that are connected to the plurality of discharge passages of an apparatus that generates noise. The primary sound reducers each include a discharge gas introduction port through which a discharge gas discharged from the corresponding discharge passage is introduced, a sound reducing region that reduces noise by allowing the discharge gas introduced from the discharge gas introduction port to pass therethrough, and a discharge port through which the discharge gas that has passed through the sound reducing region is discharged. The noise reducing device further includes a secondary sound reducer that accommodates a part of each of the plurality of primary sound reducers including at least the discharge port and that includes a space that allows the discharge gas that has passed through the primary sound reducers and been discharged from the discharge ports to pass therethrough, and a system-to-outside discharge unit that allows the discharge gas that has passed through the space to be discharged to the outside. The system-to-outside discharge unit of the secondary sound reducer is configured such that reverse flow of the discharge gas, which has been discharged from the plurality of primary sound reducers into the space of the secondary sound reducer, into the apparatus via a discharge passage from any of the plurality of primary sound reducers is suppressed (that is, back flow of discharge gas among the plurality of discharge passages is suppressed) and low pressure loss is obtained such that the discharge gas can be discharged to outside the system. Therefore, noise generated in the apparatus equipped with a plurality of discharge passages can be reduced while suppressing back flow of the discharge gas among the plurality of discharge passages.

In other words, the noise reducing device according to the embodiment of the present disclosure reduces sound in two stages, namely, a primary stage and a secondary stage, and is therefore able to obtain a high sound reduction effect.

Furthermore, since the system-to-outside discharge unit of the secondary sound reducer is configured to have low pressure loss as described above, a situation in which discharge gas introduced into the space of the secondary sound reducer from the discharge gas introduction ports of the primary sound reducers flows back into the apparatus from any of the primary sound reducers is suppressed (that is, a situation in which back flow of discharge gas among the plurality of discharge passages is caused is suppressed) and the discharge gas can be discharged to the outside.

Therefore, the noise reducing device of the embodiment of the present disclosure is used by connecting the noise reducing device to a sorted component discharge unit of a characteristic sorting machine or an appearance sorting machine employing compressed air for example, and as a result noise due to shock waves and compression waves generated with the flow of air can be efficiently reduced while avoiding a situation in which operation of the machine is hindered by preventing reverse flow of the discharge gas.

Other features, elements, characteristics and advantages of the present disclosure will become more apparent from the following detailed description of preferred embodiments of the present disclosure with reference to the attached drawings.

DETAILED DESCRIPTION

Hereafter, the present disclosure will be described in more detail by illustrating embodiments of the present disclosure.

Embodiment

Figure 1:
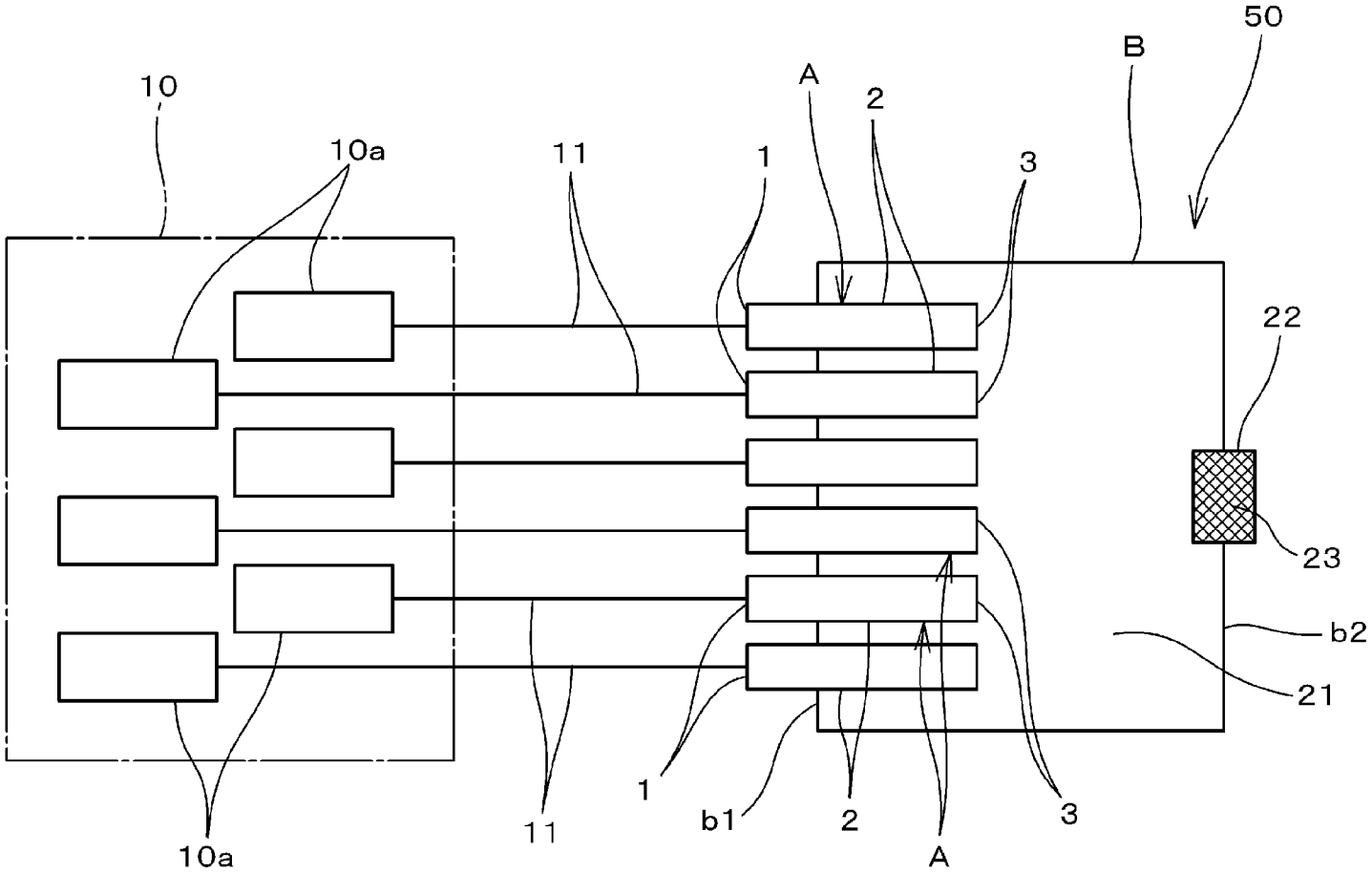
FIG. 1 schematically illustrates the configuration of a noise reducing device according to an embodiment of the present disclosure.

FIG. 1 schematically illustrates the configuration of a noise reducing device according to an embodiment of the present disclosure. As illustrated in FIG. 1, a noise reducing device 50 is a device used to reduce noise that occurs with operation of an apparatus 10, which is equipped with a plurality of discharge passages (discharge lines) 11.

In this embodiment, the apparatus 10, which is the target of noise reduction, is a characteristic sorting machine configured to detect whether a characteristic of an electronic component is non-defective or defective and convey non-defective components and defective components to certain areas by using compressed air. The apparatus 10 is equipped with discharge gas generating sources 10*a* that discharge the compressed air to be used to the outside via the discharge passages (discharge lines) 11.

Discharging of the compressed air to the plurality of discharge passages 11 is performed using switching valves such as solenoid valves that switch the compressed air on and off. The mechanism for switching the compressed air on and off is not particularly limited.

Furthermore, a variety of members such as resin tubes and copper pipes may be used as the discharge passages 11.

The noise reducing device 50 according to this embodiment is provided with a plurality of primary sound reducers A that are respectively connected to the plurality of discharge passages 11 of the apparatus (characteristic sorting machine) 10 and a secondary sound reducer B that includes part of each of the plurality of primary sound reducers A, the part including at least a discharge port 3.

Each of the primary sound reducers A respectively connected to the plurality of discharge passages 11 is a tubular member and is equipped with a discharge gas introduction port 1 that is connected to a corresponding one of the plurality of discharge passages 11 of the apparatus (characteristic sorting machine) 10 and through which the discharge gas discharged from the discharge passage 11 is introduced.

The discharge passages 11 and the discharge gas introduction ports 1 are connected to each other using pipe connectors for example.

In addition, the primary sound reducers A are each provided with a sound reducing region 2, which communicates with the discharge gas introduction port 1 and reduces noise by allowing the discharge gas introduced from the discharge gas introduction port 1 to pass therethrough, and a discharge port 3, which discharges the discharge gas that has passed through the sound reducing region 2.

There are no particular restrictions on the material forming the primary sound reducers A and for example a resin or copper material can be used.

Furthermore, the sound reducing regions 2 for example may each have (a) a structure obtained by filling a porous material such as a resin sponge, (b) an interference structure in which a pipeline connected to a sound source is provided with tubes and small holes that cause interference and that causes sound to be reduced by interfering with the sound waves, or (c) an expansion structure obtained by expanding part of a pipeline and thereby causing the fluid inside the pipeline to expand and as a result causing noise to be attenuated by reducing the speed and pressure of the fluid.

In addition, the secondary sound reducer B is a substantially cylindrical container and is provided with a space that accommodates thereinside a principle part (part including at least discharge port 3) of each of the plurality of primary sound reducers A, that receives and allows to pass therethrough the discharge gas that has passed through the sound reducing regions 2 of the primary sound reducers A and been discharged from the discharge ports 3, and that functions as a sound reducing region.

The primary sound reducers A are formed such that part of each primary sound reducer A including the discharge port 3 is inserted into and accommodated inside the space 21 from one end b1 of the secondary sound reducer B.

Furthermore, the secondary sound reducer B is provided with a system-to-outside discharge unit 22, which is for discharging the discharge gas that has passed through the above-described space 21 to the outside. In the secondary sound reducer B of this embodiment illustrated in FIG. 1, a single system-to-outside discharge unit 22 is provided at another end b2 of the secondary sound reducer B.

There are no particular restrictions on the material forming the secondary sound reducer B and for example a copper or resin material can be used. In addition the shape of the secondary sound reducer B can be any of a variety of shapes such as a circular cylindrical shape or a square cylindrical shape.

Figure 2:
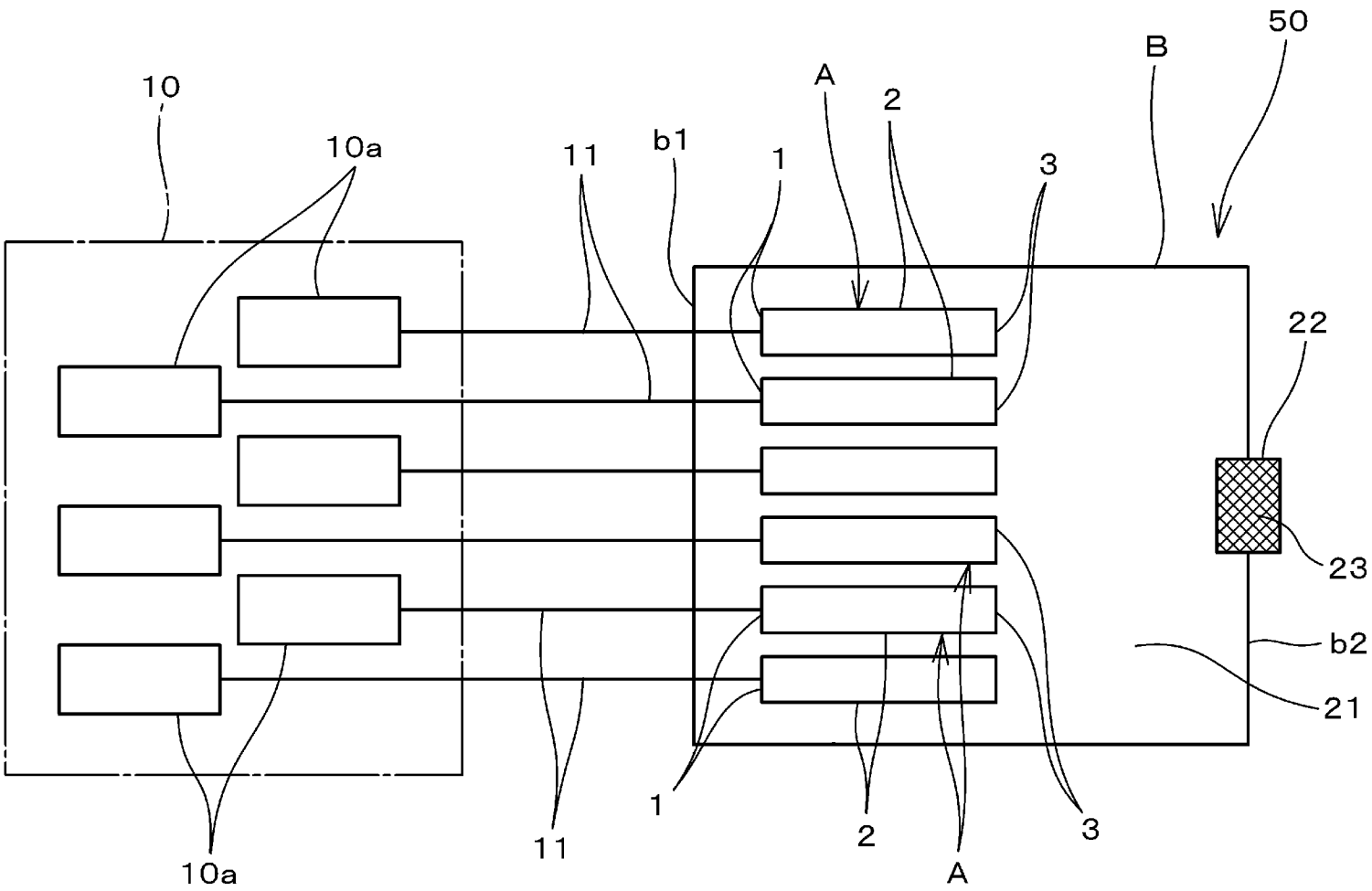
FIG. 2 schematically illustrates a modification of the noise reducing device according to the embodiment of the present disclosure.

Furthermore, although part of each of the plurality of primary sound reducers A including at least the discharge port 3 is accommodated inside the space 21 from the one end b1 of the secondary sound reducer B in this embodiment, it is possible for the entirety of each primary sound reducer A to be accommodated inside the space 21 as illustrated in FIG. 2.

In the case where the apparatus 10 provided with the plurality of discharge passages 11 intermittently jets the compressed air used to sort components for around 1/100 s to 3/100 s at predetermined intervals, the space 21 of the secondary sound reducer B preferably has a volume of substantially 80 times or more the volume of air jetted in around 1/100 s to 3/100 s.

As a result of the space 21 of the secondary sound reducer B having the above-described volume, the discharge gas can be smoothly discharged into the space 21 from the discharge passages 11 of the apparatus 10 via the primary sound reducers A.

Furthermore, in the noise reducing device 50 according to this embodiment, the system-to-outside discharge unit 22 of the secondary sound reducer B is configured so that there is low pressure loss such that a situation in which the discharge gas introduced from the discharge gas introduction ports 1 of the primary sound reducers A and discharged from the discharge ports 3 flows back into the apparatus 10 via the discharge passages 11 from any of the plurality of primary sound reducers A is suppressed and the discharge gas is discharged to outside the system with certainty.

That is, looking at the amount of discharge gas (for example, air) under constant pressure conditions that can flow per unit time through a region having a uniform cross sectional area, a configuration is adopted in which the amount of discharge gas flowing from the space to outside the system in the system-to-outside discharge unit 22 of the secondary sound reducer B is larger than the amount of discharge gas flowing from the space toward the sound reducing regions in the discharge ports 3 of the primary sound reducers A.

So long as the above requirement is satisfied, there may be any number of system-to-outside discharge units 22 of the secondary sound reducer B and a single secondary sound reducer B may be provided with a plurality of system-to-outside discharge units 22.

In addition, although there are no particular restrictions on the relationship between the number of primary sound reducers A accommodated in the secondary sound reducer B and the number of system-to-outside discharge units 22 provided in the secondary sound reducer B, the configuration of the secondary sound reducer B can be simplified by making the number of system-to-outside discharge units 22 provided in the secondary sound reducer B smaller than the number of primary sound reducers A.

Furthermore, in the noise reducing device according to this embodiment, a sound reducing material 23 is provided in the system-to-outside discharge unit 22 so that a higher sound reducing effect can be obtained.

A variety of materials can be used as the sound reducing material 23.

For example, (a) a perforated material such as a resin sponge may be used as the sound reducing material 23 and a structure obtained by filling this material can be adopted, (b) an interference structure that reduces sound by interfering with sound waves can be adopted by using a member equipped with tubes and small holes to provide interference as the sound reducing material 23 in the system-to-outside discharge unit 22, and (c) an expansion structure can be adopted that attenuates noise by causing a fluid passing therethrough to expand and thus reducing the speed and pressure of the fluid by using a member obtained by expanding part of the system-to-outside discharge unit 22 as the sound reducing material 23.

However, in the noise reducing device 50 of the present disclosure, a configuration may also be adopted in which a sound reducing material is not provided in the system-to-outside discharge unit 22 of the secondary sound reducer B.

The noise reducing device 50 according to this embodiment is configured as described above and therefore noise generated in the apparatus 10 provided with a plurality of discharge passages 11 can be efficiently reduced using two stages, namely, the primary sound reducers A and the secondary sound reducer B.

In addition, by installing a small-size primary sound reducer for each of the plurality of discharge passages and using these primary sound reducers together with a secondary sound reducer, the sound reducing effect of the noise reducing device as a whole can be sufficiently secured while reducing the installation space for the primary sound reducers compared with the case where noise is reduced using just one primary sound reducer.

Furthermore, back flow of exhaust gas among the plurality of discharge passages 11 of the apparatus 10 can be suppressed and noise can be reduced without incurring a negative effect on operation of the apparatus due to the discharge gas flowing back into the apparatus.

In addition, in this embodiment, the sound reducing material 23 is provided in the system-to-outside discharge unit 22 of the secondary sound reducer B and therefore a higher noise reduction effect can be obtained.

It is also possible to adopt a configuration in which noise reduction is realized by arranging a plurality of units each equipped with a plurality of primary sound reducers A and a single secondary sound reducer B, as described in the above embodiment, for a single apparatus having a plurality of discharge passages.

Figure 3:
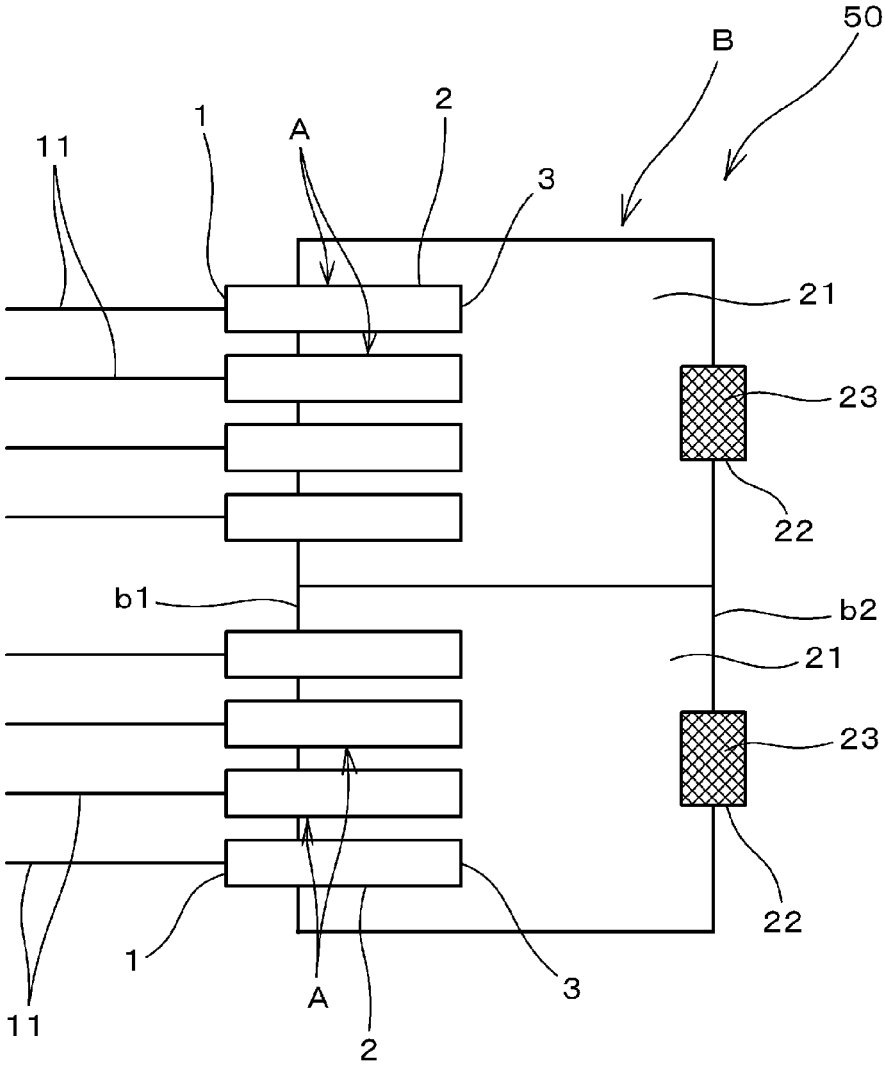
FIG. 3 schematically illustrates another modification of the noise reducing device according to the embodiment of the present disclosure.
Figure 4:
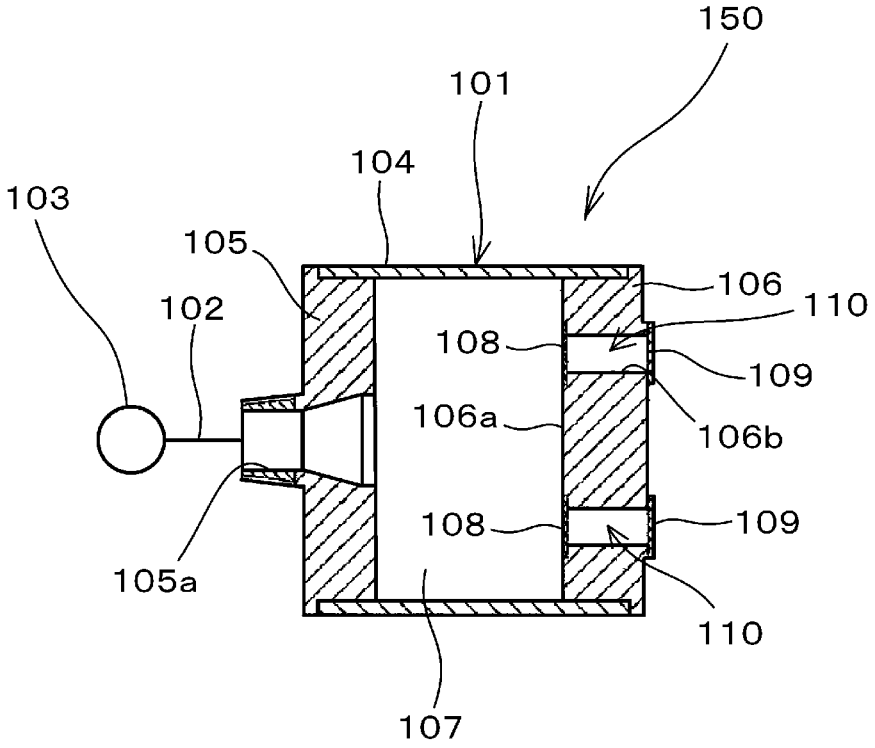
FIG. 4 PRIOR ART
FIG. 4 illustrates the configuration of a noise reducing device (sound reducer) of the related art.
Figure 5:
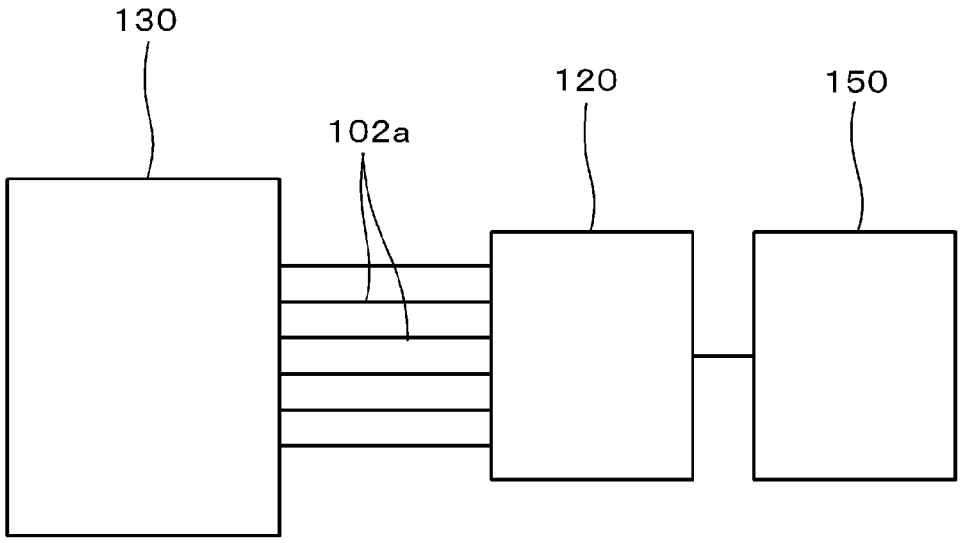
FIG. 5 PRIOR ART
FIG. 5 illustrates a device configuration for reducing noise from a noise generating source having a plurality of discharge lines by using a sound reducer of the related art.

In addition, in this embodiment, the noise reducing device 50 is described having a configuration in which a secondary sound reducer B equipped with a single space 21 is employed and a plurality of primary sound reducers A (parts of primary sound reducers A including discharge ports 3) are accommodated in the single space 21, but as illustrated in FIG. 3 a configuration may also be adopted in which a secondary sound reducer B provided with two or more spaces 21 is employed and in which a plurality of primary sound reducers A are accommodated in each space 21.

In addition, in the embodiment, the directivity of pressure loss in the primary sound reducers is not particularly limited but the primary sound reducers may have directivity in the pressure loss.

The present disclosure is not limited to the above-described embodiments in other respects and various applications and modifications can be added within the scope of the present disclosure.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A noise reducing device for an apparatus provided with a plurality of discharge passages and is to be used for reducing noise originating from discharge gas discharged from the discharge passages, the noise reducing device comprising:

(a) a plurality of primary sound reducers that are respectively connected to the plurality of discharge passages, the plurality of primary sound reducers each including a discharge gas introduction port through which a discharge gas discharged from a corresponding discharge passage is introduced, a sound reducing region that communicates with the discharge gas introduction port and reduces noise by allowing the discharge gas introduced from the discharge gas introduction port to pass therethrough, and a discharge port through which the discharge gas passed through the sound reducing region is discharged; and (b) a secondary sound reducer that accommodates a part of each of the plurality of primary sound reducers including at least the discharge port and that includes a space that allows the discharge gas that has passed through the primary sound reducers and been discharged from the discharge ports to pass therethrough, and a system-to-outside discharge unit that allows the discharge gas that has passed through the space to be discharged to outside of the system;

wherein pressure loss when moving from the space to outside the system in the system-to-outside discharge unit of the secondary sound reducer is lower than pressure loss when moving from the space to the sound reducing regions in the discharge ports of the plurality of primary sound reducers.

2. The noise reducing device according to claim 1, wherein a sound reducing material is provided in the system-to-outside discharge unit of the secondary sound reducer.

3. The noise reducing device according to claim 1, wherein the number of system-to-outside discharge units of the secondary sound reducer is smaller than the number of discharge ports of the primary sound reducers.

* * * * *